US011641948B2

(12) United States Patent
Huang

(10) Patent No.: US 11,641,948 B2
(45) Date of Patent: May 9, 2023

(54) INFLATABLE BED

(71) Applicant: BESTWAY INFLATABLES & MATERIAL CORP., Shanghai (CN)

(72) Inventor: Shuiyong Huang, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 0 days.

(21) Appl. No.: 17/506,307

(22) Filed: Oct. 20, 2021

(65) Prior Publication Data

US 2022/0125212 A1 Apr. 28, 2022

(30) Foreign Application Priority Data

Oct. 28, 2020 (CN) ..... 202022438773.1
Mar. 31, 2021 (CN) ..... 202120667868.2

(51) Int. Cl.
*A47C 27/08* (2006.01)
*A47C 27/00* (2006.01)

(52) U.S. Cl.
CPC ..... *A47C 27/081* (2013.01); *A47C 27/087* (2013.01); *A47C 27/08* (2013.01)

(58) Field of Classification Search
CPC ..... A47C 27/08; A47C 27/081; A47C 27/082; A47C 27/083; A47C 27/087; A47C 27/10;

(Continued)

(56) References Cited

U.S. PATENT DOCUMENTS 7,089,618 B1 * 8/2006 Metzger ..... A47C 27/087 5/709
8,656,540 B2 * 2/2014 Chen ..... A47C 27/081 5/710

(Continued)

FOREIGN PATENT DOCUMENTS

EP 3991610 A1 * 5/2022 ..... A47C 27/081

OTHER PUBLICATIONS

Extended European Search Report dated Mar. 18, 2022 (dated Mar. 18, 2022) issued on related European Patent Application 21203000.1 by the European Patent Office.

*Primary Examiner* — Robert G Santos
(74) *Attorney, Agent, or Firm* — Dickinson Wright PLLC

(57) ABSTRACT

An inflatable bed is provided including an upper sheet, a lower sheet, a lateral confining sheet and a first internal sheet. The lateral confining sheet connects the upper sheet and the lower sheet to define an inflatable chamber. The upper sheet has a planar portion and an oblique portion. The planar portion of the upper sheet is connected to the lower sheet by means of the first internal sheet. The lateral confining sheet comprises a circumferential portion and an extension portion extending upward along an end of the circumferential portion. The extension portion and the oblique portion of the upper sheet are connected to form a backrest of the inflatable bed, and the backrest is internally provided with a second internal sheet which is used for connecting the oblique portion of the upper sheet to the extension portion of the lateral confining sheet. The inflatable bed may further include a third internal sheet, a fourth internal sheet and a fifth internal sheet which are regionally arranged in an inner part to form an integrated backrest.

20 Claims, 8 Drawing Sheets

(58) Field of Classification Search
CPC .. A61G 7/057; A61G 7/0569; A61G 7/05776; A61G 7/05769
USPC ..... 5/706, 710–713, 654, 655.3, 644
See application file for complete search history.

(56) References Cited

U.S. PATENT DOCUMENTS

| | | | | |
|---|---|---|---|---|
| 8,661,590 | B2 * | 3/2014 | Chen | A47C 27/082 5/710 |
| 10,687,633 | B2 * | 6/2020 | Liu | A47C 27/16 |
| 10,945,533 | B1 * | 3/2021 | Shi | A47C 27/081 |
| 11,311,115 | B2 * | 4/2022 | Gao | A47G 9/1027 |
| 11,419,431 | B2 * | 8/2022 | Li | A47C 27/081 |
| 11,503,920 | B1 * | 11/2022 | Shi | A47C 27/082 |
| 11,564,505 | B2 * | 1/2023 | Liu | A47C 27/081 |
| 2013/0145560 | A1 * | 6/2013 | Chen | A47C 27/082 5/711 |
| 2013/0180052 | A1 | 7/2013 | Chen | |
| 2017/0196368 | A1 | 7/2017 | Liu | |
| 2020/0315366 | A1 * | 10/2020 | Liu | A47C 27/081 |
| 2021/0127849 | A1 * | 5/2021 | Li | A47C 27/081 |
| 2021/0169232 | A1 * | 6/2021 | Hou | A47C 27/087 |
| 2021/0196053 | A1 * | 7/2021 | Li | A47C 27/10 |
| 2021/0259434 | A1 * | 8/2021 | Wang | A47C 27/10 |
| 2021/0378412 | A1 * | 12/2021 | Gao | A47G 9/1027 |
| 2022/0125212 | A1 * | 4/2022 | Huang | A47C 27/081 |
| 2023/0029332 | A1 * | 1/2023 | Xia | A47C 21/048 |

* cited by examiner

INFLATABLE BED

CROSS-REFERENCE TO RELATED APPLICATION

This Application claims priority from Chinese Applications CN202022438773.1, filed Oct. 28, 2020 in China, and CN202120667868.2, filed Mar. 31, 2021 in China, the disclosures of which are incorporated herein by reference in their entirety.

BACKGROUND

1. Field

Apparatuses and methods consistent with example embodiments relate to inflatable products, and in particular, to an inflatable bed.

2. Description of the Related Art

Inflatable beds do not have the bulk of traditional furniture, can be placed indoors or outdoors, and have the advantages of being small in size after deflation, for convenient storage and carrying, etc. In particular, an inflatable bed with a backrest is particularly practical. According to an existing design, an inflatable bed includes a backrest separate from the body of the bed, which is a complex structure with a high production cost. Alternately, an inflatable bed with an integrated backrest usually includes an upper sheet and a lower sheet which are connected by an internal structure, such that a distance between the upper sheet and the lower sheet may be controlled by the length of the internal structure. In this way, the inflatable bed may be stretched into an inflatable bed with an integrated backrest. Such a structure, however, is relatively complicated, has a high production cost, and often poor overall aesthetics.

SUMMARY

Example embodiments may address at least the above problems and/or disadvantages and other disadvantages not described above. Also, example embodiments are not required to overcome the disadvantages described above, and may not overcome any of the problems described above.

According to an aspect of an example embodiment, an inflatable bed comprises: an upper sheet comprising a planar portion and an oblique portion; a lower sheet; a lateral confining sheet, connecting the upper sheet and the lower sheet and defining an inflatable chamber therebetween, the lateral confining sheet comprising: a circumferential portion, and an extension portion extending from an end of the circumferential portion and connected to the oblique portion of the upper sheet; a first internal sheet connecting the planar portion of the upper sheet to the lower sheet; and a second internal sheet connecting the oblique portion of the upper sheet to the extension portion of the lateral confining sheet.

The oblique portion of the upper sheet may form a front face of a backrest of the inflatable bed, and the extension portion of the lateral confining sheet may form lateral faces of the backrest.

The inflatable bed may further comprise: a third internal sheet having a ring shape and comprising an inner circumference connected to the planar portion of the upper sheet and an outer circumference connected to the lateral confining sheet.

A width of the third internal sheet at a first location adjacent to one end thereof may be greater than a width of the third internal sheet at a second location, different from the first location.

The inflatable bed may further comprise: a fourth internal sheet having a ring shape and comprising an inner circumference connected to the lower sheet and an outer circumference connected to the lateral confining sheet.

The inflatable bed may further comprise: a first vent hole formed through the third internal sheet, and a second vent hole formed through the fourth internal sheet.

The third internal sheet and the fourth internal sheet may each be one of a rectangular ring, a circular ring, or a square ring.

A cross-sectional shape of each of the first internal sheet and the second internal sheet may be one of a line, a circle, an oval, a Y-shape, and an X-shape.

The inflatable bed may further comprise: a fifth internal sheet connected to the third internal sheet at the first location and to the lower sheet.

According to an aspect of another example embodiment, an inflatable bed may comprise: an upper sheet; a lower sheet; a circumferential sheet, connecting the upper sheet and the lower sheet and defining an inflatable chamber; a plurality of first internal sheets, disposed within the inflatable chamber and each comprising a lower edge connected to the lower sheet and an upper edge connected to the upper sheet, a height of each of the first internal sheets from the lower edge to the upper edge being a first height; a second internal sheet, disposed within the inflatable chamber and comprising a first edge connected to the circumferential sheet and a second edge connected to the upper sheet; wherein a height of the inflatable bed, between the lower sheet and the upper sheet, at a first end of the inflatable bed is the first height, and a height of the inflatable bed, between the lower sheet and the upper sheet at a second end of the inflatable bed, is a second height, greater than the first height.

According to an aspect of another example embodiment, an inflatable bed comprises: an upper sheet comprising a planar portion, an oblique portion, and a transition portion disposed between the planar portion and the oblique portion; a lower sheet; a lateral confining sheet, connecting the upper sheet and the lower sheet and defining an inflatable chamber therebetween. The lateral confining sheet comprises: a circumferential portion, and an extension portion extending from an end of the circumferential portion and connected to the oblique portion of the upper sheet. The inflatable bed further comprises a first internal sheet connecting the planar portion of the upper sheet to the lower sheet; and a corner internal sheet connecting the transition portion of the upper sheet to the lower sheet.

The oblique portion of the upper sheet may form a front face of a backrest of the inflatable bed, and the extension portion of the lateral confining sheet may form lateral faces of the backrest.

The corner internal sheet may be arranged one of obliquely with respect to a vertical direction of the inflatable bed and parallel to the vertical direction of the inflatable bed.

The corner internal sheet may comprise a first corner internal sheet and a second corner internal sheet arranged one of obliquely with respect to the first corner internal sheet and parallel to the first corner internal sheet.

The first internal sheet may comprise a plurality of internal sheets, each of which comprises one of a column and a substantially planar sheet.

The inflatable bed may further comprise a second internal sheet connecting the oblique portion of the upper sheet to the extension portion of the lateral confining sheet.

The first internal sheet may comprise an array of a plurality of internal sheets, each comprising a column comprising a first portion connected to the upper sheet, a second portion connected to the lower sheet, and a third portion connecting the first portion to the second portion.

The first internal sheet may comprise a plurality of first internal sheets arranged in parallel, each of the plurality of first internal sheets comprising a substantially planar sheet extending in one of a longitudinal direction of the inflatable bed or a transverse direction of the inflatable bed.

BRIEF DESCRIPTION OF THE DRAWINGS

The above and/or other aspects will become apparent and more readily appreciated from the following description of example embodiments, taken in conjunction with the accompanying drawings. The same or similar parts are identified by the same reference numerals in the accompanying drawings, in which.

Figure 1:
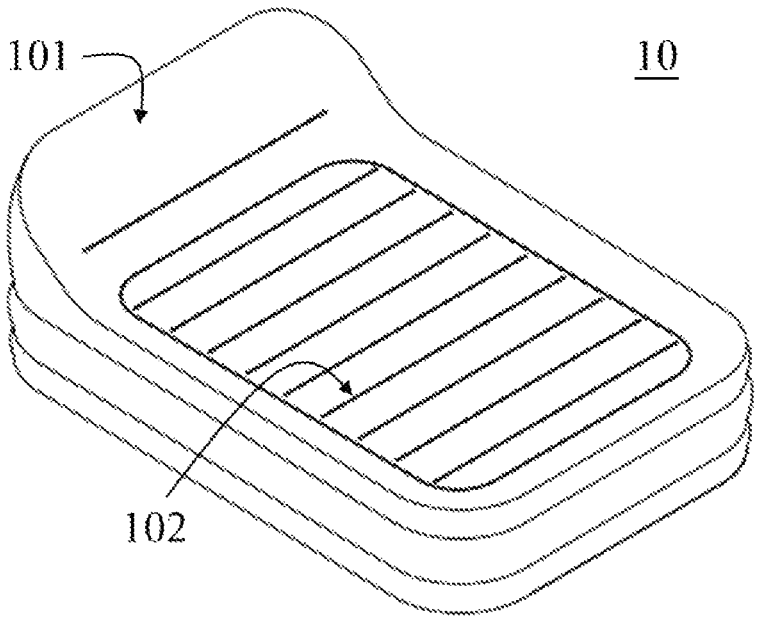
FIG. 1 is a perspective view of an inflatable bed according to an example embodiment.

Those skilled in the art will understand that elements in the figures are shown for simplicity and clarity and are not necessarily drawn to scale. For example, the dimensions of some of the elements in the figures may be enlarged relative to other elements to help improve understanding of example embodiments.

DETAILED DESCRIPTION

Reference will now be made in detail to example embodiments which are illustrated in the accompanying drawings, wherein like reference numerals refer to like elements throughout. In this regard, the example embodiments may have different forms and may not be construed as being limited to the descriptions set forth herein.

It will be understood that the terms "include," "including", "comprise, and/or "comprising," when used in this specification, specify the presence of stated features, integers, steps, operations, elements, and/or components, but do not preclude the presence or addition of one or more other features, integers, steps, operations, elements, components, and/or groups thereof.

It will be further understood that, although the terms "first," "second," "third," and "upper," "lower," "inside," "outside," etc., may be used herein to describe various elements, components, regions, layers and/or sections, these elements, components, regions, layers and/or sections may not be limited by these terms. These terms are only used to distinguish one element, component, region, layer or section from another element, component, region, layer or section.

As used herein, the term "and/or" includes any and all combinations of one or more of the associated listed items. Expressions such as "at least one of," when preceding a list of elements, modify the entire list of elements and do not modify the individual elements of the list.

Directional terms used herein, such as "transverse direction" and "longitudinal direction," refer to two directions perpendicular to each other in the horizontal direction when an inflatable bed is in a normal using position, wherein the transverse direction may be equivalent to a widthwise direction of the inflatable bed, and the longitudinal direction may be equivalent to a lengthwise direction of the inflatable bed. The directional term "vertical direction" may refer to a vertical direction when the inflatable bed is in the normal using position, namely, a height direction of the inflatable bed.

Various terms are used to refer to particular system components. Different companies may refer to a component by different names—this document does not intend to distinguish between components that differ in name but not function.

Matters of these example embodiments that are obvious to those of ordinary skill in the technical field to which these exemplary embodiments pertain may not be described here in detail.

Figure 2:
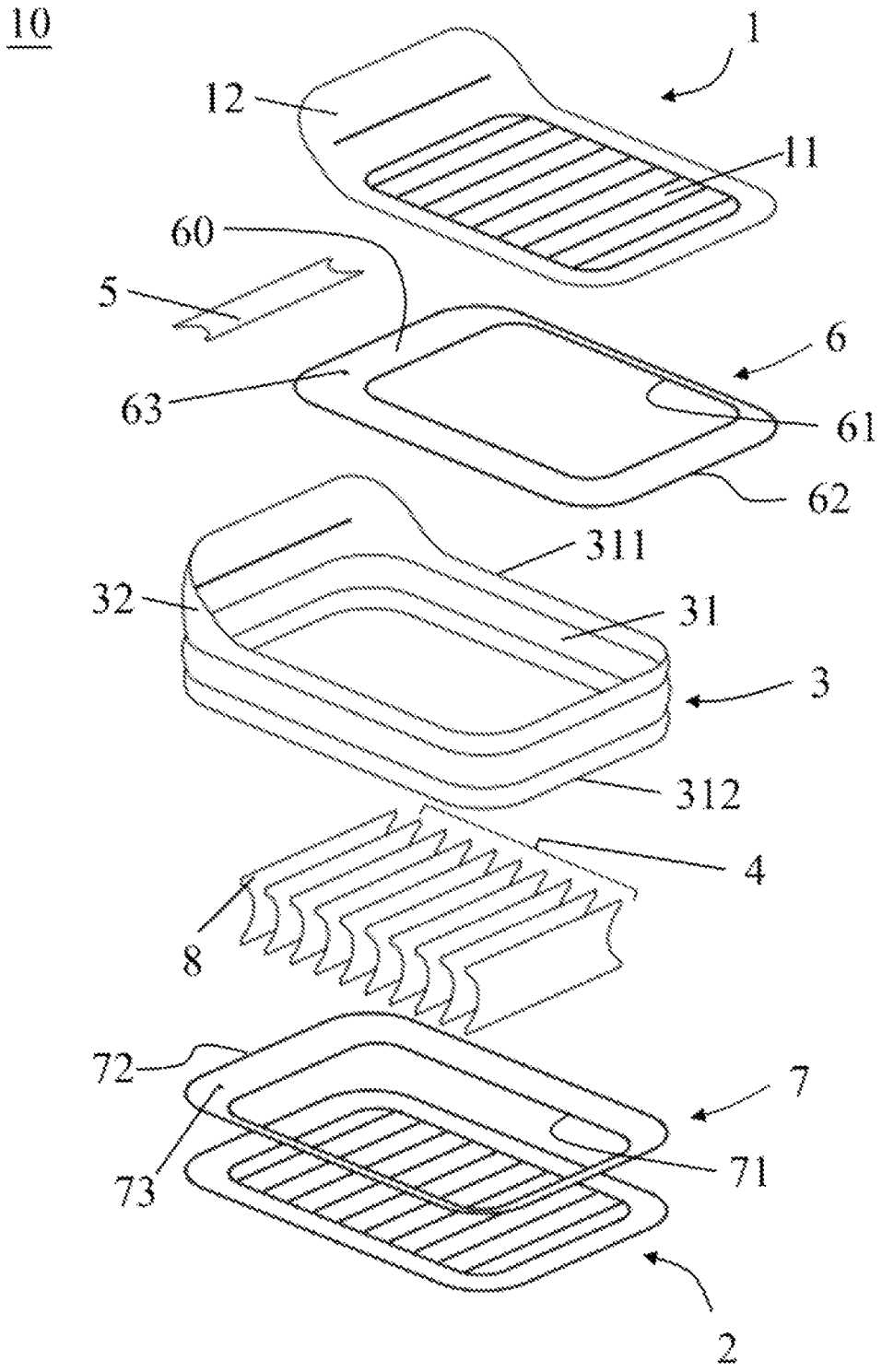
FIG. 2 is an exploded schematic view of the inflatable bed shown in FIG. 1.
Figure 3:
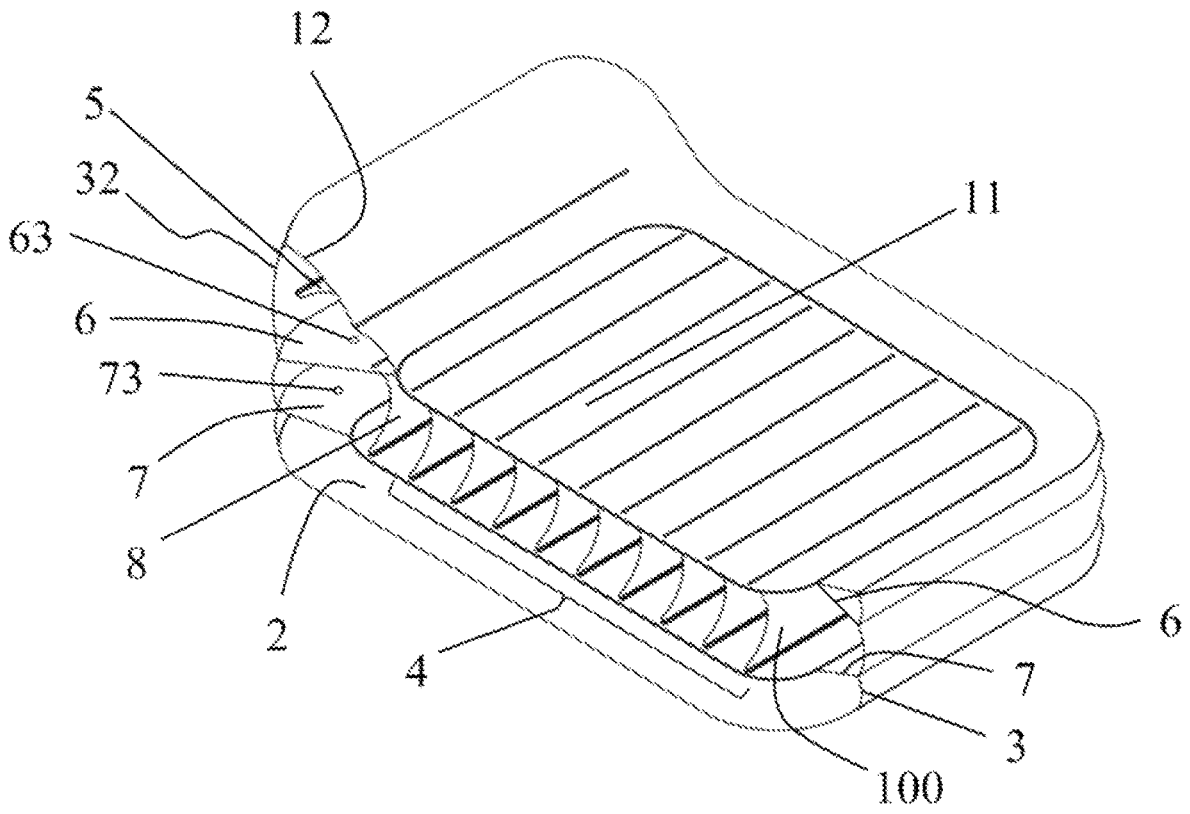
FIG. 3 is a partial sectional view of the inflatable bed shown in FIG. 1, showing an internal structure of the inflatable bed.

Referring to FIG. 1, an inflatable bed 10 has an integrated backrest 101 and an inflatable bed main body 102, wherein the inflatable bed main body 102 has a substantially flat structure, and the backrest 101 is arranged to protrude from the inflatable bed main body 102. In conjunction with an exploded schematic view of the inflatable bed 10, as shown in FIG. 2, the inflatable bed includes an upper sheet 1, a lower sheet 2, a lateral confining sheet 3, and first internal sheets 4. The upper sheet 1 forms an upper surface of the inflatable bed, the lower sheet 2 forms a lower surface of the inflatable bed, and the lateral confining sheet 3 forms a circumference of the inflatable bed. The lateral confining sheet 3 connects the upper sheet 1 and the lower sheet 2 to define an inflatable chamber 100 as shown in FIG. 3.

The upper sheet 1 may have a non-planar construction, and an upper edge 311 of the lateral confining sheet 3 may be connected to an outer, circumferential edge of the upper sheet 1. The lower sheet 2 may have a substantially planar construction, and a lower edge 312 of the lateral confining sheet 3 may be connected to an outer, circumferential edge of the lower sheet 2.

In particular, the upper sheet 1 may be integrally provided with a planar portion 11 and an oblique portion 12. The planar portion 11 may be connected to the lower sheet 2 by means of the first internal sheets 4, as well as the lateral confining sheet 3. The oblique portion 12 may form a front face of the backrest 101. The upper sheet 1 may be formed by welding, adhering, or hot melting the planar portion 11 to a separate oblique portion 12. The lateral confining sheet 3 comprises a circumferential portion 31, extending around the outer circumference of the inflatable bed 10, and an extension portion 32, which extends upward from an end of the circumferential portion 31. The extension portion 32 is connected to the oblique portion 12 of the upper sheet 1 to form the backrest 101 of the inflatable bed 10, and the extension portion 32 of the lateral confining sheet 3 forms the side faces and a back face of the backrest 101. In order to facilitate the backrest 101 of the inflatable bed 10 in supporting the pressure of a user after being inflated, the backrest 101 may include a second internal sheet 5, disposed within the backrest 101, which connects the oblique portion 12 of the upper sheet 1 to the extension portion 32 of the lateral confining sheet 3.

The first internal sheets 4 contribute to the inflated shape of the inflatable bed main body 102, and the second internal sheet 5 contributes to the inflated shape of the backrest 101. It should be noted that the number of the first internal sheets 4 and the second internal sheet 5 shown in FIG. 2 and FIG. 3 is merely an example. The bed 10 may include any one or more first internal sheets and any one or more second internal sheets. Further, each of the first and second internal sheets 4 and 5 can have a cross-sectional shape which is straight (as shown in FIG. 2 and FIG. 3), a round hole, Y-shaped, or X-shaped, as would be understood by one of skill in the art.

According to an aspect of another example embodiment, the inflatable bed 10 may further comprise a third internal sheet 6. The third internal sheet 6 may have a two-dimensional (2D) toroid shape or other ring shape with an inner circumference 61 connected to the planar portion 11 of the upper sheet 1, and an outer circumference 62 connected to the lateral confining sheet 3.

In particular, as shown in FIG. 2, a width of the end 60 of the third internal sheet 6 adjacent to the backrest 101 may be greater than a width of the remaining portion of the third internal sheet 6 so as to adapt to the transition from the inflatable bed main body 102 to the backrest 101.

According to an aspect of another example embodiment, the inflatable bed 10 may further comprise a fourth internal sheet 7. The fourth internal sheet 7 may have a 2D toroid shape or other ring shape with an inner circumference 71 connected to the lower sheet 2, and an outer circumference 72 connected to the lateral confining sheet 3.

The third internal sheet 6 may include a first vent hole 63, and the fourth internal sheet 7 may include a second vent hole 73, such that air chambers separated by the third internal sheet 6 and the fourth internal sheet 7 are in communication by means of the first vent hole 63 and the second vent hole 73.

The inflatable bed main body 102, as shown in FIG. 2 and FIG. 3, is substantially rectangular, and the third internal sheet 6 and the fourth internal sheet 7 are shown as substantially rectangular 2D toroid or rectangular rings. However, the inflatable bed main body 102 may alternately be circular, square, and or another shape, and therefore, the third internal sheet 6 and the fourth internal sheet 7 may also have different shapes, such as a circular 2D toroid, or a square 2D toroid or other ring shape.

According to an aspect of another example embodiment, the inflatable bed 10 may further comprise a fifth internal sheet 8. The fifth internal sheet 8 is connected to the end 60 of the third internal sheet 6, adjacent to the backrest 101 and the lower sheet 2. Particularly, when a width of the end 60 of the third internal sheet 6 is greater than a width of the remaining portion of the third internal sheet 6, the fifth internal sheet 8 pulls the end 60 of the third internal sheet 6 that has the greater width so as to prevent its easy deformation due to its greater width and to better prevent a transition area, where the oblique portion 12 and the planar portion 11 of the upper sheet 1 are connected, from protruding upward and affecting an overall contour of the inflatable bed.

The various internal sheets may be connected to other elements of the bed 10 by welding, hot melting, adhering, or another method as would be understood by one of skill in the art.

Figure 4:
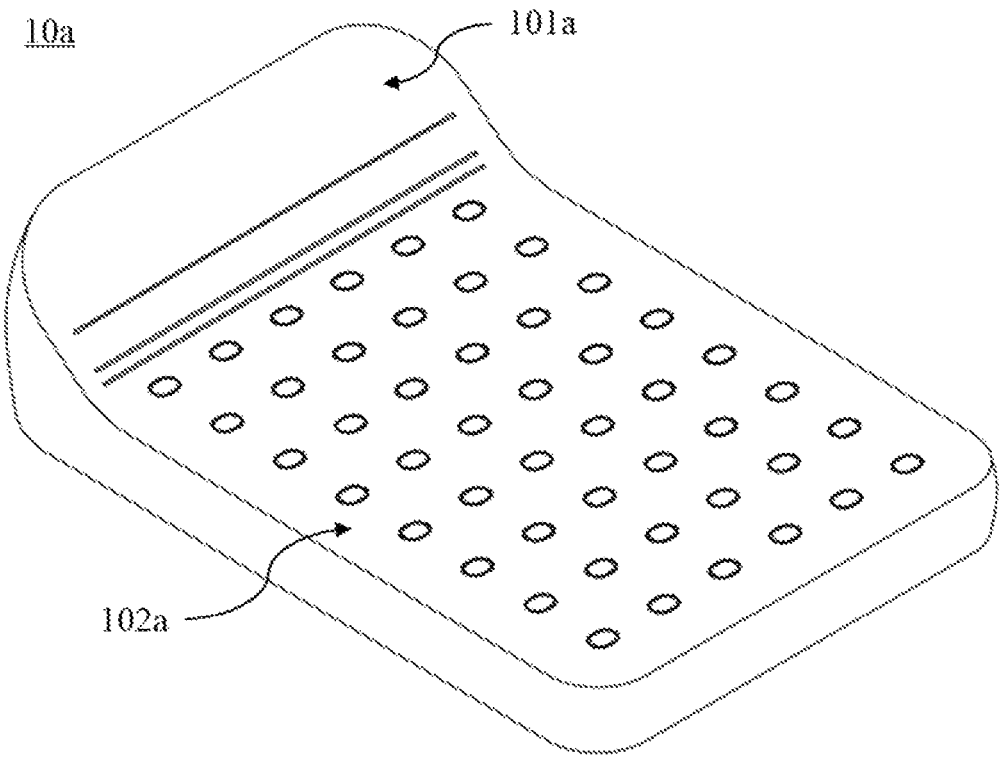
FIG. 4 is a perspective view of an inflatable bed according to another example embodiment.

FIG. 4 illustrates an inflatable bed 10*a* with an integrated backrest 101*a*, according to another example embodiment. In this example embodiment, the other portion of the inflatable bed 10*a*—i.e. that portion that does not include the backrest 101*a*, is referred to as an inflatable bed main body 102*a*, wherein the inflatable bed main body 102*a* has a substantially flat structure, and the backrest 101*a* protrudes from the inflatable bed main body 102*a*. In conjunction with an exploded schematic view of the inflatable bed 10*a* as exemplified in FIG. 5, the inflatable bed 10*a* includes an upper sheet 1*a*, a lower sheet 2*a*, a lateral confining sheet 3*a* and a first internal sheet 4*a*. The upper sheet 1*a* forms an upper surface of the inflatable bed, the lower sheet 2*a* forms a lower surface of the inflatable bed, and the lateral confining sheet 3*a* forms a circumference of the inflatable bed. The lateral confining sheet 3*a* connects the upper sheet 1*a* and the lower sheet 2*a* to define an inflatable chamber 100*a* as shown in FIG. 6.

The upper sheet 1*a* may have a non-planar structure, and an upper edge 311*a* of the lateral confining sheet 3*a* may be connected to the edge of the upper sheet 1*a*. The lower sheet 2*a* may have a planar structure, and a lower edge 312*a* of the lateral confining sheet 3*a* may be connected to the edge of the lower sheet 2*a*. Therefore, the lower sheet 2*a* forms a bottom face of the inflatable bed 10*a*, and the bottom face completely touches a supporting face (e.g., the ground) after air inflation, to provide stability for the inflatable bed 10*a*.

Specifically, the upper sheet 1*a* includes a planar portion 11*a*, a bent portion 12*a*, and a transition portion 13*a* located between the planar portion 11*a* and the bent portion 12*a*. The planar portion 11*a* is connected to the lower sheet 2*a* through the first internal sheet 4*a*, and the bend portion 12*a* forms a front face of the backrest 101*a*. The lateral confining sheet 3*a* comprises a surrounding portion 31*a* and an extension portion 32*a* extending upward along an end of the surrounding portion 31*a*, the extension portion 32*a* and the bent portion 12*a* of the upper sheet 1*a* are connected to form the backrest 101*a* of the inflatable bed 10*a*, and the extension portion 32*a* of the lateral confining sheet 3*a* forms a side face and a back face of the backrest 101*a*.

Figure 5:
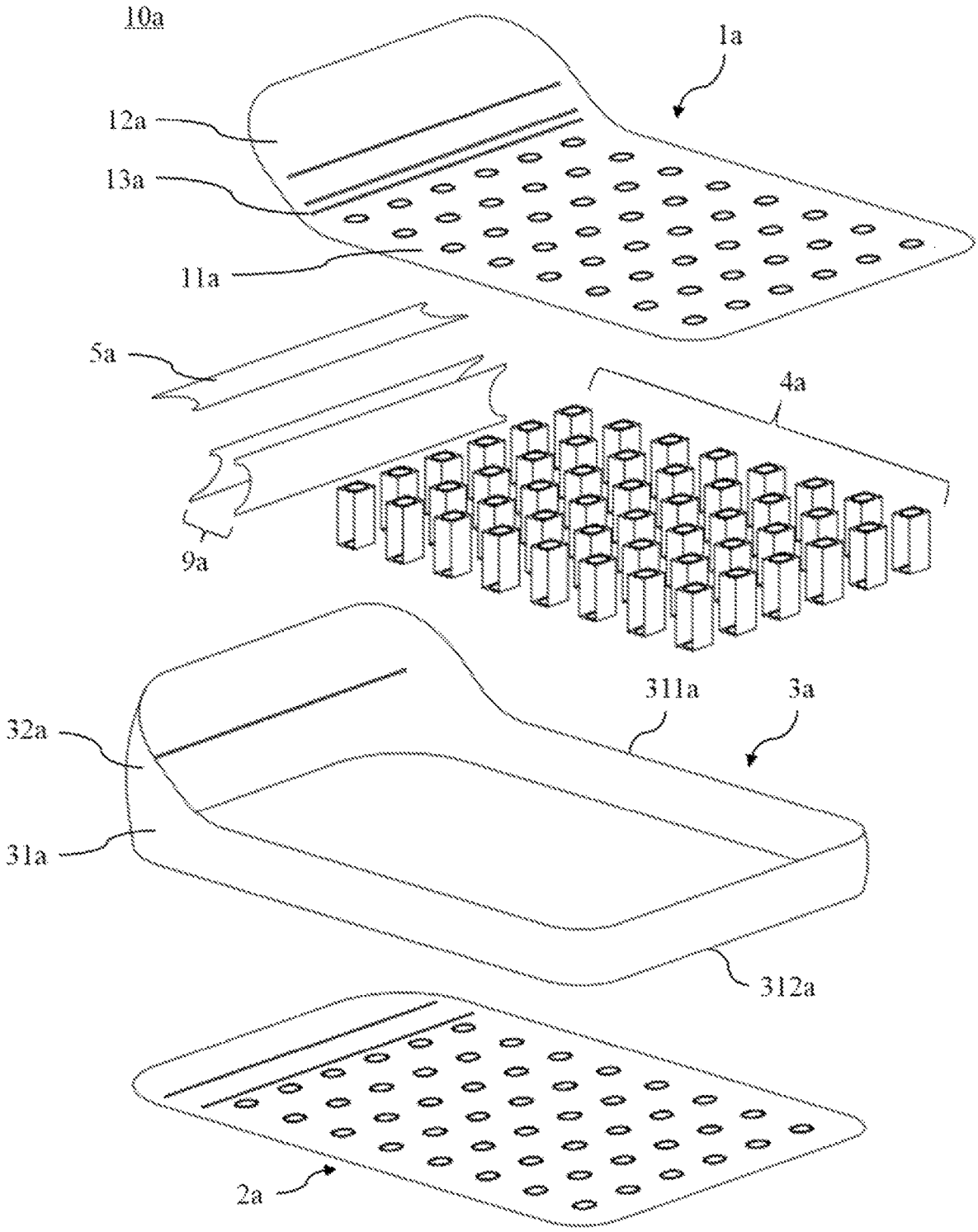
FIG. 5 is an exploded schematic view of the inflatable bed shown in FIG. 4.
Figure 6:
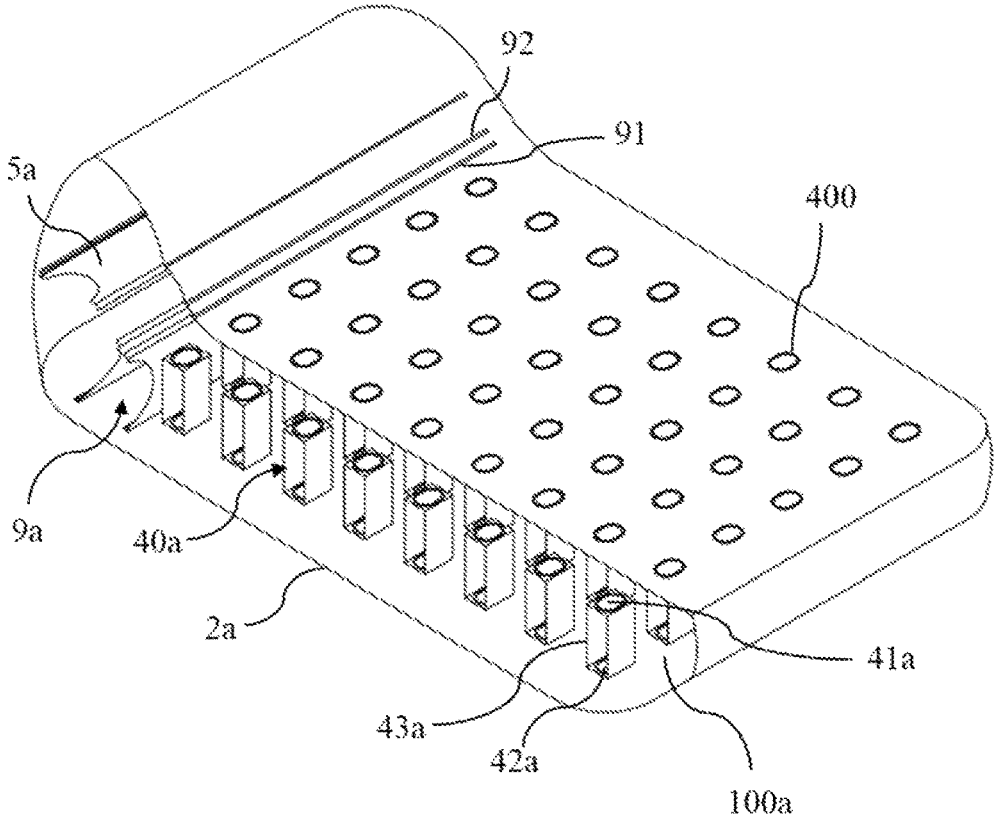
FIG. 6 is a partial sectional view of the inflatable bed shown in FIG. 4, showing an internal structure of the inflatable bed.
Figure 7:
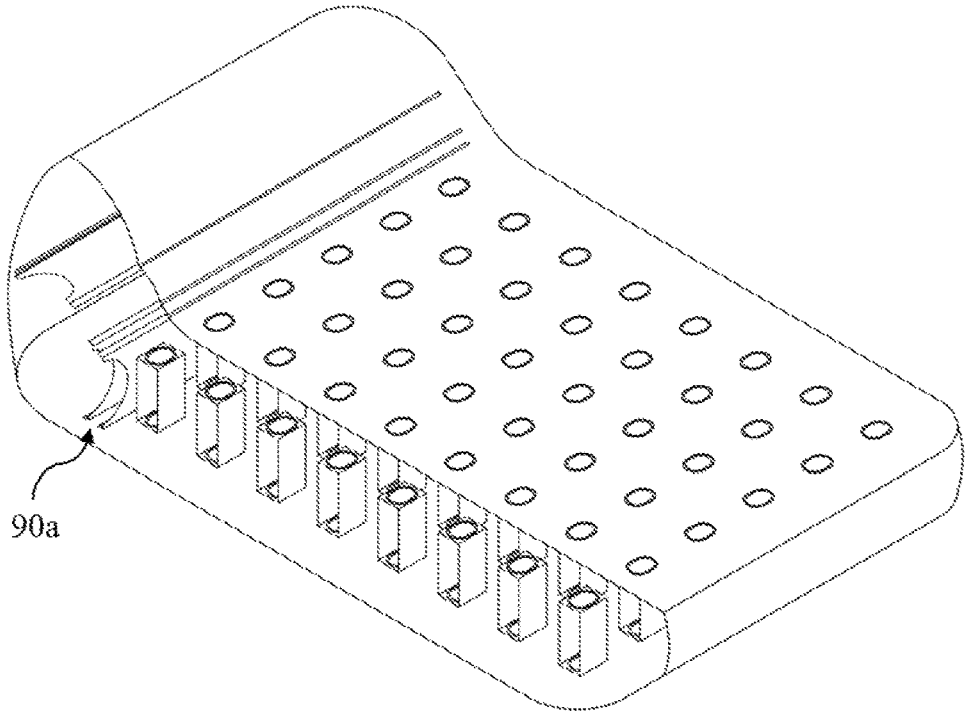
FIG. 7 is a partial sectional view of the inflatable bed shown in FIG. 4, showing another internal structure of an example inflatable bed.

Referring to FIG. 5, for the upper sheet 1*a*, the planar portion 11*a* of the upper sheet keeps the surface thereof flat through the first internal sheet 4*a*. In order to avoid a situation in which the transition portion 13*a* of the upper sheet 1*a* bulges and becomes deformed during air inflation and then affects the flatness of the planar portion 11*a*, the inflatable bed 10*a* may further include corner internal sheets 9*a*, and the corner internal sheets 9*a* connect the transition portion 13*a* of the upper sheet 1*a* and the lower sheet 2*a*. The corner internal sheets 9*a* are obliquely arranged relative to a vertical direction of the inflatable bed 10*a* and/or arranged in the vertical direction of the inflatable bed 10*a*, and the corner internal sheets 9*a* may comprise at least two internal sheets angled to each other and/or arranged parallel to each other. Specifically, taking FIG. 6 as an example, one of the two piece-like corner internal sheets 9*a* is obliquely arranged relative to the vertical direction of the inflatable bed 10*a*, the other corner internal sheet is arranged in the vertical direction of the inflatable bed 10*a*, and the two piece-like corner internal sheets 9*a* are angled with respect to each other. Linear connection outlines formed by connecting the piece-like corner internal sheets to the transition portion 13*a* may extend in a transverse direction of the inflatable bed, taking, for example, the two parallel connection outlines 91, 92 formed by connecting the corner internal sheets 9*a* to the upper sheet 1*a* shown in FIG. 6, the two parallel connection outlines 91, 92 enable the transition portion 13*a*, between the planar portion 11*a* and the bent portion 12*a*, to form clear and rounded corners, and a situation in which the transition portion 13*a* bulges and deforms during air inflation is avoided, thereby further enabling the flatness of the planar portion 11*a*. In other words, the corner internal sheets 9*a* draw the transition portion 13*a* in a direction closer to the bottom face and the back face of the inflatable bed 10*a*. FIG. 7 shows corner internal sheets 90*a* in another arrangement mode, wherein the two illustrative piece-like corner internal sheets 90*a* are both arranged in the vertical direction of the inflatable bed, and the two piece-like corner internal sheets 90*a* are arranged parallel to each other. It should be noted that as for more corner internal sheets, the arrangement directions of the corner internal sheets and the arrangement angles relative to other corner internal sheets are not limited by the drawings, and in addition, the plurality of corner internal sheets can have the same or different dimensions and specifications.

The inflatable bed 10*a* may further comprise a second internal sheet 5*a*, and the second internal sheet 5*a* connects the bent portion 12*a* of the upper sheet 1*a* and the extension portion 32*a* of the lateral confining sheet 3*a*, so that after the inflatable bed 10*a* is inflated, the backrest 101*a* of the inflatable bed can bear pressing of a user, and the backrest of the inflatable bed can be prevented from bulging and deforming after the inflatable bed is inflated. It should be noted that the number of the second internal sheet 5*a* is not limited by the drawings.

Referring to FIGS. 4-7, it can be seen that the first internal sheet 4*a* forms a specific pattern on the surface of the inflatable bed 10*a*. The first internal sheet 4*a* comprises a plurality of columnar internal sheets 40*a*, and the plurality of columnar internal sheets 40*a* are arranged in an array manner; each columnar internal sheet 40*a* comprises a first portion 41*a* connected to the upper sheet 1*a*, a second portion 42*a* connected to the lower sheet 2*a*, and a third portion 43*a* connecting the first portion 41*a* and the second portion 42*a*; and the first portion 41*a*, the second portion 42*a* and the third portion 43*a* form an integrated columnar shape. Further, the first portion 41*a* and the second portion 42*a* of each columnar internal sheet 40*a* are connected to the upper sheet 1*a* and the lower sheet 2*a*, respectively, so that closed connection outlines 400 are formed on the surface of the inflatable bed 10*a*, and the closed connection outlines 400 for example, include but are not limited to circular connection outlines, polygonal connection outlines, star connection outlines, raindrop-shaped connection outlines and other closed connection outlines.

Figure 8:
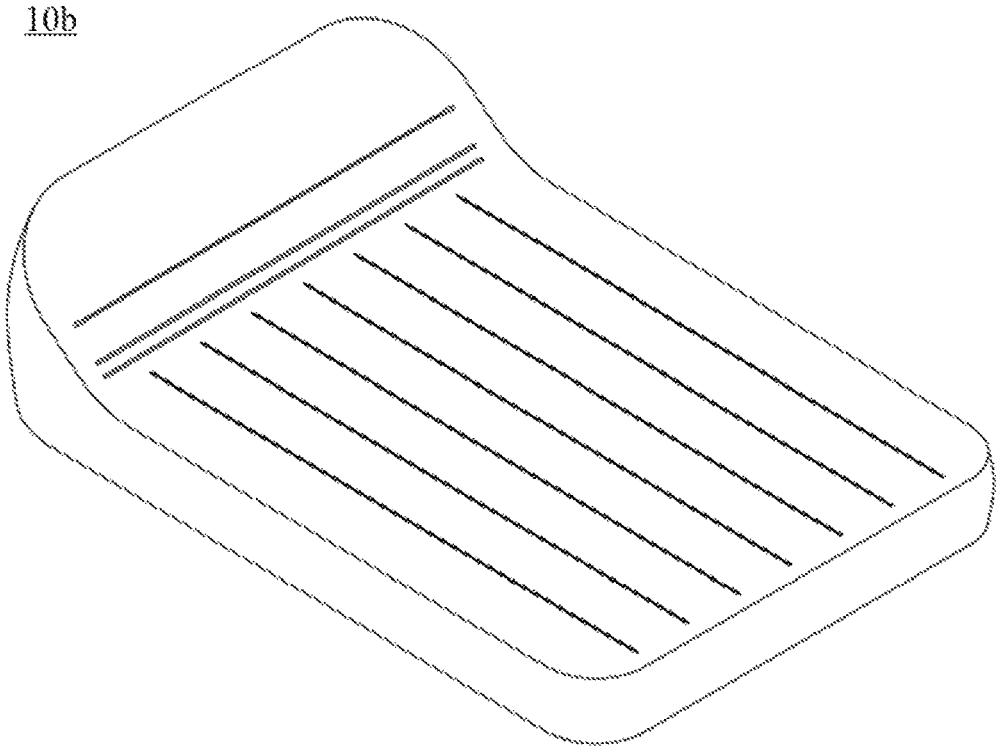
FIG. 8 is a perspective view of an inflatable bed of another example embodiment.
Figure 9:
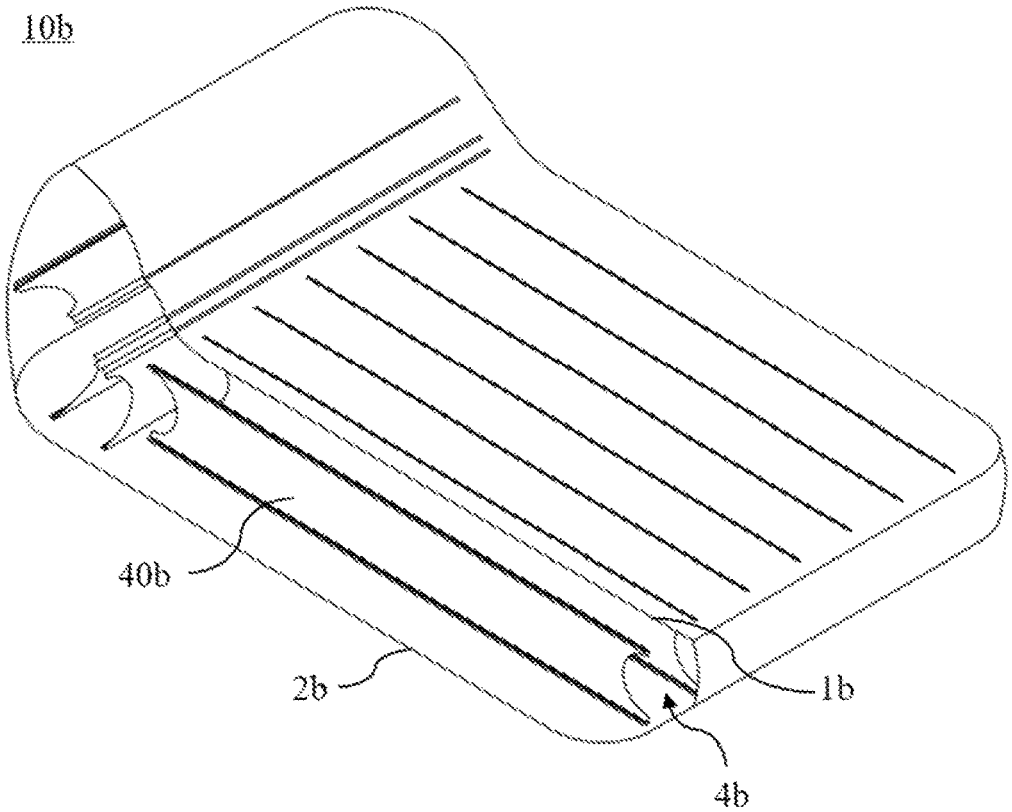
FIG. 9 is a partial sectional view of the inflatable bed shown in FIG. 8, showing an internal structure of the inflatable bed.

FIGS. 8 and 9 show an inflatable bed 10*b* of another example embodiment. The difference between the inflatable bed 10*b* and the inflatable bed 10*a* lies in the structure of the first internal sheet. A first internal sheet 4*b* of the inflatable bed 10*b* comprises a plurality of piece-like internal sheets 40*b*, the plurality of piece-like internal sheets 40*b* are arranged in parallel, and each piece-like internal sheet 40*b* is connected to an upper sheet 1*b* and a lower sheet 2*b*, respectively, so that linear connection outlines are formed on the surface of the inflatable bed 10*b*. Further, the linear connection outlines formed on the inflatable bed 10*b* by the piece-like internal sheets 40*b* are arranged in parallel in a longitudinal direction of the inflatable bed 10*b*.

Figure 10:
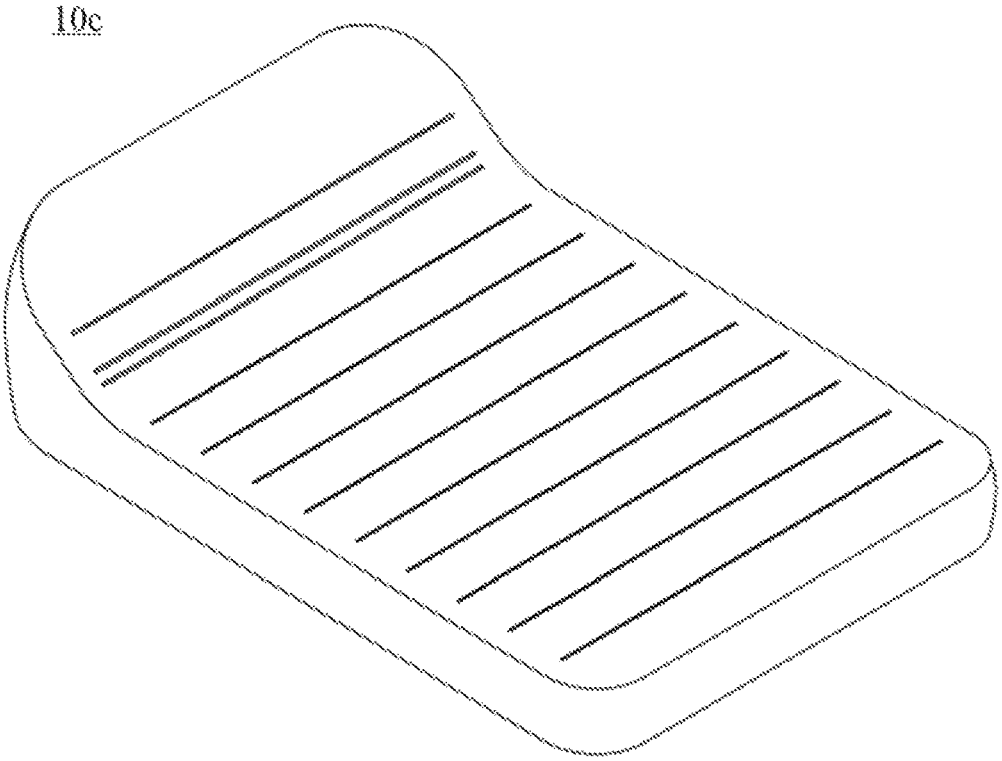
FIG. 10 is a perspective view of an inflatable bed of another example embodiment.
Figure 11:
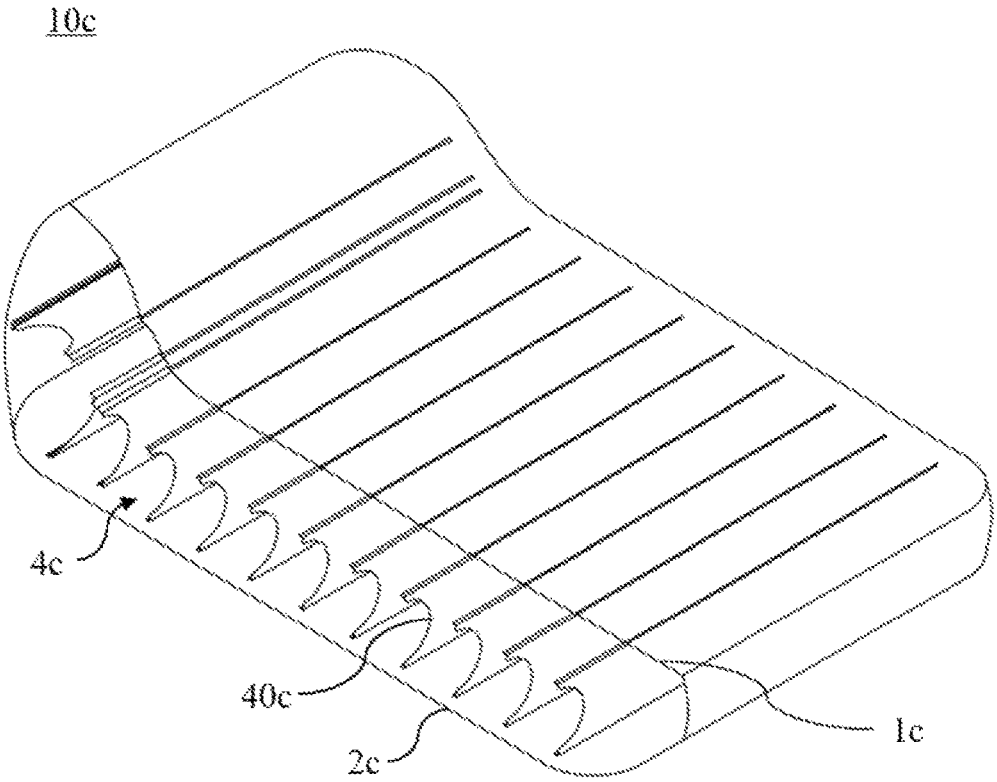
FIG. 11 is a partial sectional view of the inflatable bed shown in FIG. 10, showing an internal structure of the inflatable bed.

FIGS. 10 and 11 show an inflatable bed 10*c* of another example embodiment. The difference between the inflatable bed 10*c* and the inflatable bed 10*a* lies in the structure of the first internal sheet. A first internal sheet 4*c* of the inflatable bed 10*c* comprises a plurality of piece-like internal sheets 40*c*, the plurality of piece-like internal sheets 40*c* are arranged in parallel, and each piece-like internal sheet 40*c* is connected to an upper sheet 1*c* and a lower sheet 2*c*, respectively, so that linear connection outlines are formed on the surface of the inflatable bed 10*c*. Further, different from the inflatable bed 10*b*, the linear connection outlines formed on the inflatable bed 10*c* by the piece-like internal sheets 40*c* arranged in parallel in a transverse direction of the inflatable bed 10*c*.

The first internal sheet constructed as a piece-like internal sheet may be a straight piece-like internal sheet, as shown in FIG. 9 and FIG. 11, or can be a Y-shaped piece-like internal sheet or an X-shaped piece-like internal sheet.

One or more of the various internal sheets may be connected by welding, hot melting, or adhering.

One or more inflatable beds of example embodiments described herein form the integrated backrest by means of regionally arranging internal sheets in an inner part, which may overcome the defects of a more complicated internal structure and lesser overall aesthetics, while maintaining good stability, a reduced production cost, and a simplified structure.

It may be understood that the example embodiments described herein may be considered in a descriptive sense only and not for purposes of limitation. Descriptions of features or aspects within each example embodiment may be considered as available for other similar features or aspects in other example embodiments.

While example embodiments have been described with reference to the figures, it will be understood by those of ordinary skill in the art that various changes in form and details may be made therein without departing from the spirit and scope as defined by the following claims.

What is claimed is:

1. An inflatable bed, comprising:

an upper sheet comprising a planar portion and an oblique portion disposed at a first end of the inflatable bed;

a lower sheet;

a lateral confining sheet, connecting the upper sheet and the lower sheet and defining an inflatable chamber therebetween, the lateral confining sheet comprising:

a circumferential portion extending around an entire circumference of the inflatable bed and comprising a lower edge connected to an entirety of a circumference of the lower sheet and an upper edge connected to the planar portion of the upper sheet, and an extension portion extending from the upper edge of the circumferential portion at the first end of the inflatable bed and connected to the oblique portion of the upper sheet;

a first internal sheet connecting the planar portion of the upper sheet to the lower sheet; and a second internal sheet connecting the oblique portion of the upper sheet to the extension portion of the lateral confining sheet;

wherein a height of the first end of the inflatable bed is a combined height of the circumferential portion and the extension portion of the lateral confining sheet and is greater than a height of a second end of the inflatable bed which is a height of only the circumferential portion of the lateral confining sheet.

2. The inflatable bed according to claim 1, wherein the oblique portion of the upper sheet forms a front face of a backrest of the inflatable bed, and the extension portion of the lateral confining sheet forms lateral faces of the backrest.

3. The inflatable bed according to claim 1, further comprising:

a third internal sheet having a ring shape and comprising an inner circumference connected to the planar portion of the upper sheet and an outer circumference connected to the lateral confining sheet.

4. The inflatable bed according to claim 3, wherein a width of the third internal sheet at a first location adjacent to one end thereof is greater than a width of the third internal sheet at a second location, different from the first location.

5. The inflatable bed according to claim 4, further comprising:

a fourth internal sheet having a ring shape and comprising an inner circumference connected to the lower sheet and an outer circumference connected to the lateral confining sheet.

6. The inflatable bed according to claim 5, further comprising a first vent hole formed through the third internal sheet, and a second vent hole formed through the fourth internal sheet.

7. The inflatable bed according to claim 5, wherein the third internal sheet and the fourth internal sheet are each one of a rectangular ring, a circular ring, or a square ring.

8. The inflatable bed according to claim 1, wherein a cross-sectional shape of each of the first internal sheet and the second internal sheet is one of a line, a circle, an oval, a Y-shape, and an X-shape.

9. The inflatable bed according to claim 5, further comprising a fifth internal sheet connected to the third internal sheet at the first location and to the lower sheet.

10. An inflatable bed, comprising:

an upper sheet;

a lower sheet;

a circumferential sheet, connecting the upper sheet and the lower sheet and defining an inflatable chamber, wherein the circumferential sheet extending around an entire circumference of the inflatable bed and comprising a lower edge connected to an entirety of a circumference of the lower sheet;

a plurality of first internal sheets, disposed within the inflatable chamber and each comprising a lower edge connected to the lower sheet and an upper edge connected to the upper sheet, a height of each of the first internal sheets from the lower edge to the upper edge being a first height;

a second internal sheet, disposed within the inflatable chamber and comprising a first edge connected to the circumferential sheet and a second edge connected to the upper sheet;

wherein a height of the inflatable bed, between the lower sheet and the upper sheet, at a first end of the inflatable bed is the first height, and a height of the inflatable bed, between the lower sheet and the upper sheet at a second end of the inflatable bed, is a second height, greater than the first height.

11. The inflatable bed according to claim 10, further comprising a third internal sheet having a ring shape and comprising an inner circumference connected to the upper sheet and an outer circumference connected to the circumferential sheet.

12. The inflatable bed according to claim 11, wherein a width of the third internal sheet at a first location adjacent to the second end of the inflatable bed is greater than a width of the third internal sheet at a second location adjacent to the first end of the inflatable bed.

13. An inflatable bed, comprising:

an upper sheet comprising an oblique portion disposed at a first end of the inflatable bed, a planar portion disposed at a second end of the inflatable bed, and a transition portion disposed between the planar portion and the oblique portion;

a lower sheet;

a lateral confining sheet, connecting the upper sheet and the lower sheet and defining an inflatable chamber therebetween, the lateral confining sheet comprising:

a circumferential portion extending around an entire circumference of the inflatable bed and comprising a lower edge connected to an entirety of a circumference of the lower sheet and an upper edge connected to the planar portion of the upper sheet, and an extension portion extending from the upper edge of the circumferential portion at the first end of the inflatable bed and connected to the oblique portion of the upper sheet;

a first internal sheet connecting the planar portion of the upper sheet to the lower sheet; and a corner internal sheet connecting the transition portion of the upper sheet to the lower sheet;

wherein a height of the first end of the inflatable bed is a combined height of the circumferential portion and the extension portion of the lateral confining sheet and is greater than a height of a second end of the inflatable bed which is a height of only the circumferential portion of the lateral confining sheet.

14. The inflatable bed according to claim 13, wherein the oblique portion of the upper sheet forms a front face of a backrest of the inflatable bed, and the extension portion of the lateral confining sheet forms lateral faces of the backrest.

15. The inflatable bed according to claim 13, wherein the corner internal sheet is arranged one of obliquely with respect to a vertical direction of the inflatable bed and parallel to the vertical direction of the inflatable bed.

16. The inflatable bed according to claim 15, wherein the corner internal sheet comprises a first corner internal sheet and a second corner internal sheet arranged one of obliquely with respect to the first corner internal sheet and parallel to the first corner internal sheet.

17. The inflatable bed according to claim 13, wherein the first internal sheet comprises a plurality of internal sheets, each of which comprises one of a column and a substantially planar sheet.

18. The inflatable bed according to claim 17, further comprising a second internal sheet connecting the oblique portion of the upper sheet to the extension portion of the lateral confining sheet.

19. The inflatable bed according to claim 13, wherein the first internal sheet comprises an array of a plurality of internal sheets, each comprising a column comprising a first portion connected to the upper sheet, a second portion connected to the lower sheet, and a third portion connecting the first portion to the second portion.

20. The inflatable bed according to claim 13, wherein the first internal sheet comprises a plurality of first internal sheets arranged in parallel, each of the plurality of first internal sheets comprising a substantially planar sheet extending in one of a longitudinal direction of the inflatable bed or a transverse direction of the inflatable bed.

* * * * *